United States Patent [19]

Asanae et al.

[11] 4,277,552

[45] Jul. 7, 1981

[54] MAGNETIC DEVELOPING PROCESS AND TONER CONTAINING HIGH COERCIVE FORCE MAGNETIC POWDER

[75] Inventors: Masumi Asanae; Kohji Noguchi, both of Kumagaya, Japan

[73] Assignee: Hitachi Metals, Ltd., Japan

[21] Appl. No.: 99,853

[22] Filed: Dec. 3, 1979

Related U.S. Application Data

[63] Continuation-in-part of Ser. No. 23,000, Mar. 22, 1979, abandoned.

[30] Foreign Application Priority Data

Mar. 23, 1978 [JP] Japan ..... 53-33530

[51] Int. Cl.[3] ..... G03G 13/09

[52] U.S. Cl. ..... 430/122; 430/107; 430/903

[58] Field of Search ..... 430/122, 107, 903

[56] References Cited

U.S. PATENT DOCUMENTS

| | | | |
|---|---|---|---|
| 2,890,968 | 6/1959 | Gioimo | 430/122 |
| 3,239,465 | 3/1966 | Rheinfrank | 430/122 |
| 3,345,294 | 10/1967 | Cooper | 430/122 |
| 3,455,276 | 7/1969 | Anderson | 430/122 |
| 3,816,840 | 6/1974 | Kotz | 430/122 |
| 3,925,219 | 12/1975 | Strong | 430/122 |

*Primary Examiner*—John D. Welsh

*Attorney, Agent, or Firm*—Finnegan, Henderson, Farabow, Garrett & Dunner

[57] ABSTRACT

Disclosed is an electrostatic image developing process using a magnet roll and a magnetic toner of specified flux density.

10 Claims, 3 Drawing Figures

MAGNETIC DEVELOPING PROCESS AND TONER CONTAINING HIGH COERCIVE FORCE MAGNETIC POWDER

This application is a continuation-in-part application of Ser. No. 23,000 filed Mar. 22, 1979 for "MAGNETIC TONER CONTAINING HIGH COERCIVE FORCE MAGNETIC POWDER", now abandoned.

This invention relates to a developing process of electrostatic latent images which uses single component magnetic toner, particularly to a magnet brush developing process.

BACKGROUND OF THE INVENTION

In a magnet-brush development process, developer powder, which includes magnetic material, stored in a developer vessel is conveyed to a development zone and attracted to a magnet roll. Image-bearing material, positioned adjacent the magnet roll, may be composed of a highly resistive polyester sheet, photoconductive selenium, an electrically insulating film overlying a layer of photoconductive cadmium sulfide disposed in an insulating binder, a thin film of polyvinylcarbazole or poly-N-vinylcarbazole, a layer of the mixture of photoconductive zinc oxide and an insulating resin binder, or the like, as known in the art.

The developer powder is supplied from the developer vessel through a gap of predetermined size onto the magnet roll and, according to the rotation of the magnet roll, the developer powder rotates or tumbles along the roll to the development zone. At least at the development zone, the developer powder forms a magnet-brush on the magnet roll and the magnet-brush rubs the surface of the image-bearing material to adhere the toner material of the developer powder to electric pattern images on the surface. For purposes of this application, electric pattern images include electrostatic images, capacitive images, and electrically conductive images. For convenience of explanation, the latent electrostatic images will be used as representative in this specification.

In some previous developing processes the development, there has been used an admixture of ferromagnetic carrier particles and toner particles. The ferromagnetic carrier particles are resin-coated-iron beads and the toner particles are a mixture of pigment and binder. The carrier particles and the toner particles are triboelectrically charged to the opposite polarity by blending them. The materials of the carrier particles and the toner particles are selected to cause a charge on the toner opposite to the charge of the electrostatic latent image on the image-bearing material. The admixture is stored in the developer vessel in which the toner particles adhere to the surfaces of the carrier particles by the triboelectric charge and is then conveyed on the surface of the magnet roll as the roll rotates. The admixture forms a magnet-brush at the development zone and, when the brush rubs the latent image, the toner particles adhere to the latent image by the electrostatic attraction force between the charge of the latent image and the charge of the toner, but the carrier particles remain on the magnetic roll by the magnetic attraction force between the carrier and the roll. After the development the admixture, less the adhered toner, returns to the developer vessel and is supplied new toner.

On the other hand, a single component magnetic toner has been improved to be used in the magnet-brush development and has the advantage that it is not necessary to use the carrier particles or to mix them. Although such a magnetic toner is referred to as "single component" or "one component," the name does not mean that the toner consists of only one component, but the toner comprises mainly one kind of particles composed of fine magnetic particles, organic binder, pigment, carbon black and flow agents. No so-called "carrier" is required.

A toner containing magnetic material is shown in Giaimo, Jr. U.S. Pat. No. 2,890,968, Copper U.S. Pat. No. 3,345,294 and Strong U.S. Pat. No. 3,925,219. Giaimo, Jr. teaches that two kinds of magnetic powder are mixed so that one kind of the magnetic powder is charged triboelectrically to a polarity while the other has an opposite charge and that the mixture in conveyed to a photoreceptor with latent images by rotation of a magnet roll to form a magnet brush on the surface of magnet roll and, by attraction force between the charge of the magnetic powder and that of the latent images the latent images are developed visible. One of those powders consists of polystyrene, carbon black, Nigrosine and magnetite while the other consists of Vinsol, Carmine dye and magnetite.

Cooper discloses a developer mixture of ferromagnetic carrier particles and tones particles containing carbon black, magnetite and resin. The content of magnetite is 28.75% by weight.

Since both Giaimo, Jr. and Cooper are used with carrier particles, those are triboelectrically chargeable.

Single component magnetic toner is, for example, disclosed in Strong. The magnetic toner of Strong is composed of wax and ethylene/vinyl acetate copolymer as a resin and magnetite of 60 weight %. Instead of magnetite, Strong suggests barium ferrite, nickle zinc ferrite, chromium oxide, nickle oxide, etc may be useable. When the toner is conveyed to a position close to latent images, an electric charge of opposite polarity to the electric charge of the latent images is induced in the toner by subjecting the toner to the electric field of the latent images, so the toner is attracted to the latent images to adhere the latent images.

The structure of the magnet roll is well-known and is shown, for example, in Anderson, U.S. Pat. No. 3,455,276. Anderson refers to a magnet roll as a magnetically responsive powder applicator, which comprises a shaft of high magnetic permeability material, a plurality of elongate, generally sector-shaped in cross section, magnetic members formed of fine grain, permanent magnet material dispersed in a non-magnetic matrix, which members are positioned to define a circular array around the shaft, the alternate, outer faces of adjacent members being oppositely polarized.

In development with admixture of ferromagnetic carrier particles and toner particles, it is usual that a magnet roll having a magnetic force of 600–1,300 gauss on a shell surface is used. The carrier particles which have toner particles triboelectrically adhered on them are magnetically held and conveyed by a magnet roll and form magnet brush along magnetic flux lines. A relatively weak magnetic flux density of the magnet roll causes white spots on a copy paper because carrier particles are transfered together with toner particles to a photoreceptor. By this reason, a magnet roll having a relatively strong magnetic force with such "two coomponent" toners.

On the other hand, when a single component magnetic toner is used in development, a magnet roll having a relatively weak magnetic force on the shell surface is used. In development processes using single component toners, only when the electrostatic attraction force between latent images and toner becomes larger than magnetic attraction force between the magnetic toner and the magnet roll, are the toner particles removed from the shell surface of the magnet roll and transferred to the latent images. For this reason, if the magnetic force of the magnet roll is too strong, development might not occur. But, when the magnetic force is too weak, toner is attracted by a very small electric potential on a photoreceptor, and the background of the copy paper becomes dark from the transfer of unwanted toner.

A large magnetic brush formed on a magnet roll causes blackness of developed images, i.e. a diffuse reflection density, to increase. The large magnetic brush is formed by a large magnetic force of the magnet roll. Also, the magnitude of the magnetic brush depends on magnetic properties of magnetic toner.

The adherence of toner to the background of the copy paper discussed above concerns magnetic characteristics of the magnetic toner.

As a result, the quality of developed images depends on the magnetic characteristics of the magnetic toner and the magnetic force of the magnet roll.

The toner utilized in these reproducing steps in a "plain paper copier" (PPC) system ordinarily includes magnetic powder and a resin. The magnetic properties, particle size and electric resistance of the magnetic toner, as a whole, and the content ratio between the magnetic powder and the resin form important factors for determining the quality of the images reproduced. Particularly, in the above developing step, the magnetic properties of the magnetic toner greatly affect the developing performance. Increases in the magnetic force of the magnetic toner tend to improve the developing property. While an increase in the magnetic powder content of the magnetic toner generally increases the magnetic force of the toner and improves the developing property of the toner, an increase in the magnetic powder content in the magnetic toner, however, results in a roughness of the fixed images caused by the magnetic powder thereon in the course of the fixing step. Images of a satisfactory quality are, therefore, not obtained.

SUMMARY OF THE INVENTION

The main object of the present invention is to provide a developing process of electrostatic latent images for developing the images to highly black copy which has low background.

The present invention is accomplished by a developing process of electrostatic latent images comprising:

providing a magnet roll which includes a cylindrical rotatable shell and a rotatable permanent magnet member positioned coaxially within the shell, the permanent magnet member having a plurality of adjacent axially extending magnetic poles causing a magnetic field pattern of at least 400 gauss as its peak value on the shell surface;

supplying single component magnetic toner which consists essentially of at least a resin, which is solid at ambient temperature and rendered molten under heating, coloring material and at most 40%, by weight, of ferromagnetic powder, the magnetic toner having a saturated magnetic flux density $4\pi Is$ of a value between 300 and 1,000 gauss and a magnetic property, in the relation between the saturated magnetic flux density 4#Is and the coercive force iHc of the magnetic toner, defined by the region above a line connecting a point where iHc is 1,000 oersted for 4#Is at 300 gauss and a point where iHc is 200 oersted for $4\pi Is$ at 300 gauss and below a line connecting a point where iHc is 400 oersted for $4\pi Is$ at 300 gauss and a point where iHc is 400 oersted for $4\pi Is$ at 1,000 gauss; conveying the single component magnetic toner on the shell surface to an image-bearing material having the electrostatic latent images by rotating at least one of the shell and the permanent magnet member to form a magnet brush of the single component magnet toner;

inducing an electric charge on the magnetic toner in the magnet brush on the shell surface adjacent the image-bearing material by subjecting to an electrical field due to an electric charge of the electrostatic latent images; and rubbing the image-bearing material by the magnet brush to adhere the charged magnetic toner onto the electrostatic latent images on the image-bearing material by the attraction force between the charge induced in the toner and that of the electrostatic latent images.

The magnet roll used in the present invention preferably shows a magnetic flux density of between 400 and 1,500 gauss as its peak value. The more preferable range of the flux density is 600–1,200 gauss.

The magnetic toner used in the present invention preferably consists essentially of, by weight, magnetic powder of 20–55%, a plastic binder of 80–45% and carbon black of 0.2–6%. The magnetic powder may be barium ferrite powder, strontium ferrite powder or cobalt powder. The plastic binder may be epoxy resin, ethylenvinyl acetate copolymer or wax. Instead of the carbon black, nickel powder may be used. The more preferable content of the magnetic powder is 25 to 40%.

DETAILED DESCRIPTION OF THE EMBODIMENTS

Figure 2:
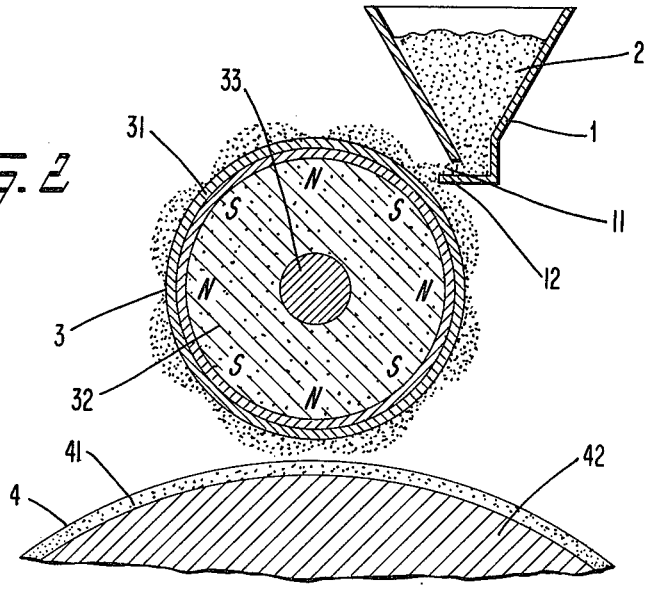
FIG. 2 is a schematic cross-section of the apparatus accomplishing the present invention.

Referring to FIG. 2, single component magnetic, toner 2 is stored in toner vessel 1 which has an opening 11 at the position opposite to a magnet roll 3. The toner 2 is supplyed onto the surface of a shell 31 of the magnet roll 3 through the opening 11.

The magnet roll 3 has a permanent magnet 32 held on a shaft 33 inside the non-magnetic cylindrical shell 31. The permanent magnet 32 is secured on the shaft 33 and the shell 31 rotates relatively to the magnet 32. Both the shell and the magnet rotate. When the shell 31 rotates clockwise, or when the magnet 32 rotates counter clockwise, the toner is transported clockwise.

An image-bearing drum 4 is juxtaposed with the magnet roll 3 and the image-bearing material 41 is disposed on a peripheral surface of a conductive backing 42.

Electrostatic latent images are formed by a conventional process on the image-bearing material 41.

Figure 1:
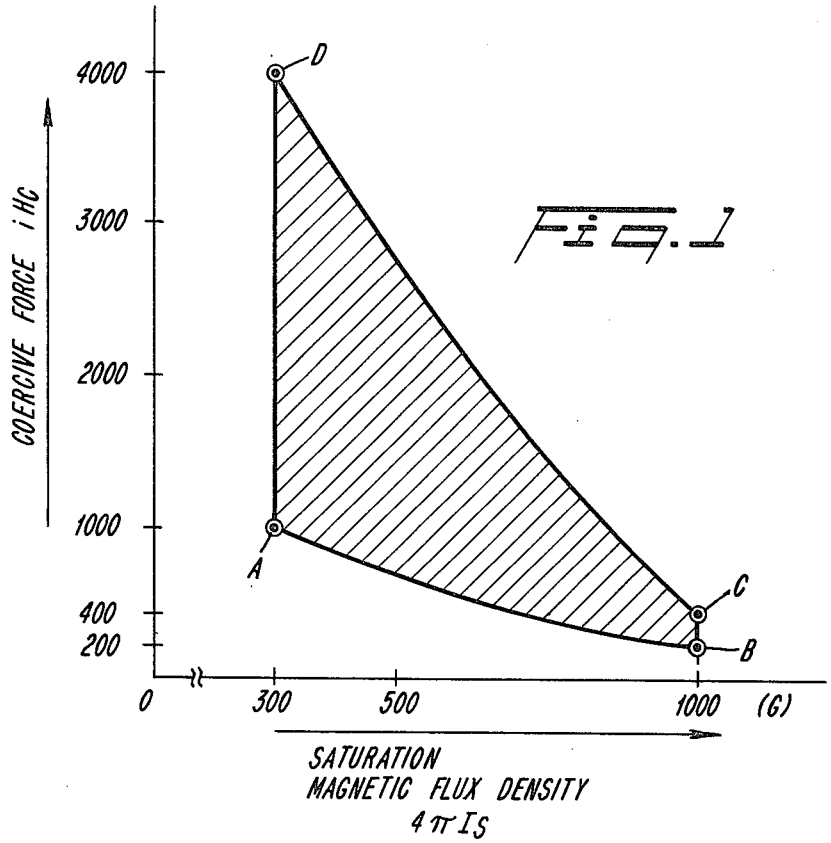
FIG. 1 shows a relative region between the saturated magnetic flux density 4#Is and the coercive force iHc in the magnetic toner preferably used in the present invention.

FIG. 1 shows the magnetic properties of the single component magnetic toner to be used in the present invention. The toner has saturated magnetic flux density $4\pi Is$ of a value between 300 and 1,000 gauss and a magnetic property, in the relation between the saturated magnetic flux density $4\pi Is$ and the coercive force iHc of the magnetic toner, defined by the region above a line connecting a point where iHc is 1,000 oersted for $4\pi Is$ at 300 gauss and a point where iHc is 200 oersted for $4\pi Is$ at 300 gauss and below a line connecting a point where iHc is 400 oersted for $4\pi Is$ at 300 gauss and a point where iHc is 400 oersted for $4\pi Is$ at 1,000 gauss, shown as a hatched area ABCD in FIG. 1.

The magnetic toner which has been supplied on the shell surface of the magnet roll 3 from the toner vessel 1 is conveyed under a doctor blade 12 in the direction of the image-bearing material 41 by rotation of the shell 31 or the permanent magnet 32. A magnetic brush of the toner is formed along magnetic flux lines of the permanent magnet 32 on the shell surface. When the magnet brush reaches the latent images on the image bearing material, an electric charge is induced in the toner subjected to the electric field due to the electric charge of the latent images. The induced charge has a polarity opposite to that of the latent images. The charge of the toner is attracted electrically to the latent images so that the toner adheres to the latent images which become visible.

The toner images may be fixed directly on the image-bearing material such as in a "coated paper copier" (CPC) process. Alternatively, the toner images may be transfered to another material, i.e. a plain paper, and fixed thereon by pressure or heat in a PPC process.

Figure 3:
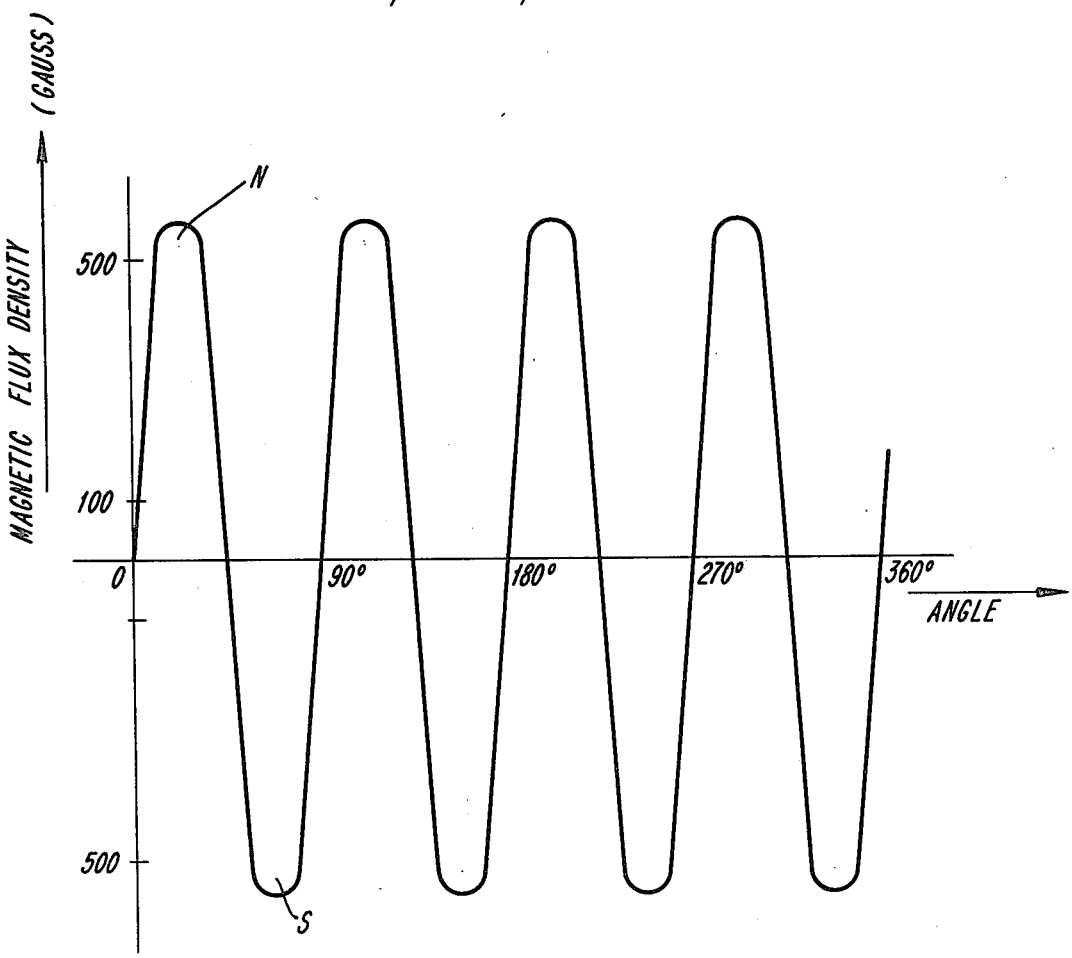
FIG. 3 is a graph showing a magnetic flux density distribution along the peripheral surface of the magnet roll.

The permanent magnet 32 shown in FIG. 2 has been magnetized to have eight adjacent axially elongated magnetic poles symmetrically on the peripheral surface. The magnetic flux density distribution on the shell surface has four north poles and four south poles and a magnetic flux density of about 550 gauss at the peaks, as shown in FIG. 3. THe magnetic force of the magnet roll and the magnetic properties of the magnetic toner affect the force of attracting and holding the toner to the shell surface. The increase of magnetic flux density on the shell increases the attraction force and reduces toner amount transferred and adhered to the latent images. When a saturated magnetic flux density $4\pi Is$ of toner, or the content of ferromagnetic powder in the toner, increases, toner amount adhered to latent images reduces. So, in order to obtain clear background, it is useful to use a strong magnet and a toner having a large magnetic flux density.

However, it is not practicable to use a magnet having too strong magnetic force. In general, an isotropic barium ferrite magnet exhibits magnetic flux density of 400–800 gauss and an anisotropic barium ferrite magnet has magnetic flux density of 900–1,300 gauss. A rare earth-cobalt magnet is relatively expensive, but shows a high magnetic flux density of about 2,000 gauss.

Magnetic flux density of between 400 and 1500 gauss is suitable to a development of electrostatic latent images with inductively chargeable, single component magnetic toner. It is preferred to combine a magnet roll having surface magnetic flux density of 400 gauss with magnetic toner with magnetic powder of 55%. Surface magnetic flux density of 1,500 gauss goes nicely with toner with 20% magnetic powder.

When magnetic toner with 25–40% magnetic powder is used, an isotropic barium ferrite gives toner images of high quality. It is most preferable that a magnet roll with magnetic flux density of 600–1,200 gauss is combined with magnetic toner having magnetic powder of 25–40%.

As toner to be used in the process of the present invention, the followings were prepared.

Toner A

Polyester resin (PS No. 1; prepared by Hitachi Chemicals) of 50 weight parts and magnetite (MTA740; prepared by Toda Industry) of 50 weight parts were premixed by a super mixer. The mixed powder was heated too 150°–200° C. and blended by a needer at the temperature, and then cooled and became solid. The solid material was pulverized by a jet mill and speroidized at a temperature of 100°–200° C. Carbon black of 1 weight % was added to the particles and mixed by a mixer to be fixed on the particle surface. The particles were classified to select particle size of 5–30 $\mu$m.

Toner B

Epoxy resin (Epicot 2057GP; Shell Chemicals) of 75 weight parts and barium ferrite magnet powder (YBM-IB; Hitachi Metals) of 25 weight parts were used and treated as in the process described in Toner A.

Toner C

Stylene (Himer ST95; Sanyo Chemicals) of 60 weight parts and barium ferrite magnet powder (YBM-3; Hitachi Metals) of 40 weight parts were treated as in the process described in Toner A.

Toner D

Epoxy resin (Epicot 1004; Shell Chemicals) of 70 weight parts, barium ferrite magnet powder (YBM-2B; Hitachi Metals) of 15 weight parts and magnetite (EPT500; Toda Industry) of 15 weight parts were treated as in the process described in Toner A.

Toner E

Epoxy resin (Epicot 1004; Shell Chemicals) of 30 weight parts, and magnetite (EPT 500; Toda Industry) of 70 weight parts were treated as in the process described in Toner A.

Toner F

Epoxy resin (Epicot 2057GP; Shell Chemicals) of 80 weight parts and barium ferrite magnet powder of 20 weight parts were treated as in the process described in Toner A.

Evaluation of toner images where were developed by using Toners A to F is shown in the following table.

TABLE

| | Toner Properties | | | | Experiment Condition | | | Image Quality | | |
|---|---|---|---|---|---|---|---|---|---|---|
| | | | | | Photoconductor | | Magnetic force of mag. | | | |
| Toner | Particle size (μm) | Conductivity at 4000V/cm (ohm/cm) | 4πIs (gauss) | iHc (Oe) | Material | Voltage (V) | roll (gauss) | Develop-ment | Toner Scattering | Fixability |
| A | 5-30 | $5 \times 10^{-13}$ | 1,000 | 370 | Se | 800 | 850 | good | no | good |
| B | " | $8 \times 10^{-14}$ | 310 | 2,050 | Se | 600 | 1,300 | good | little | good |
| C | " | $1 \times 10^{-15}$ | 310 | 4,000 | Se | 650 | 1,200 | good | no | good |
| D | " | $3 \times 10^{-15}$ | 480 | 1,760 | ZnO | −300 | 1,200 | good | little | good |
| E | " | $2 \times 10^{-14}$ | 1,700 | 130 | Se | 1,000 | 500 | good | no | bad |
| F | " | $3 \times 10^{-15}$ | 124 | 4,000 | ZnO | −300 | 1,200 | bad | yes | good |

It is apparent from this Table that Toner E gave images that had been well developed but was poorly fixed and was nonsmooth, since the toner contains large amount of magnetic powder and has high saturated magnetic flux density. Toner F which contains a small amount of magnetic powder gave a good fixability but a poor developability and a large toner scattering on the background because it has low saturated magnetic flux density.

By contrast, Toners A to D contain suitable amount of magnetic powder and have high saturated flux density, so they gave a good developability and fixability and no toner scattering on the background.

What we claim is:

1. In a process for developing latent electrostatic images with a single component toner consisting essentially of a resin which is solid at ambient temperature and rendered molten under heating, coloring material, and a ferromagnetic powder, the toner being used in a developing apparatus having a latent image-bearing material for carrying the latent images and a magnet roll which includes a cylindrical rotatable shell and a rotatable permanent magnet member positioned coaxially within the shell, the permanent magnet member having a plurality of adjacent axially extending magnetic poles, the process including the steps of (a) attracting the toner to the surface of the magnet roll shell;

(b) conveying the single component magnetic toner on the shell surface to the latent image-bearing material having the electrostatic latent images previously disposed thereon by rotating at least one of the shell and the permanent magnet member to form a magnet brush of the single component magnetic toner;

(c) inducing an electric charge on the magnetic toner in the magnet brush on the shell surface adjacent the latent image-bearing material by subjecting the brush to the electric field due to the electric charge of the electrostatic latent images; and (d) rubbing the image-bearing material by the magnet brush to adhere the charged magnetic toner onto the electrostatic latent images on the image-bearing material by the attraction force between the charge induced in the toner and that of the electrostatic latent images, the improvement comprising the initial step of selecting the magnetic toner and the permanent magnet member in respect to one another according to the following relation:

(i) the permanent magnet member to produce a magnetic field strength of at least about 400 gauss at its peak value on the shell surface;

(ii) the magnetic toner to comprise at most about 55%, by weight, of ferromagnetic powder; and (iii) the magnetic toner to have saturated magnetic flux density 4πIs of a value between about 300 and 1,000 gauss and a magnetic property, in the relation between the saturated magnetic flux density 4πIs and the coercive force iHc of the magnetic toner, lying within the region on a graph of coercive force iHc, in oersteds, vs. saturation flux density 4πIs, in gauss, above a line connecting a point where iHc is 1,000 oersted for 4πIs at 300 gauss and a point where iHc is 200 oersted for 4πIs at 300 gauss and below a line connecting a point where iHc is 400 oersted for 4πIs at 300 gauss and a point where iHc is 400 oersted for 4πIs at 1,000 gauss.

2. The process as set forth in claim 1, further comprising:

transferring to another surface the toner image formed by the adherence of the magnetic toner to the image-bearing material; and fixing the toner image on said another surface.

3. The process as set forth in claim 2, wherein the step of fixing is accomplished by heating.

4. The process as set forth in claim 2, wherein the step of fixing is accomplished by pressure.

5. The process as set forth in claim 2, wherein the step of fixing is accomplished by applying heat and pressure.

6. The process as set forth in claim 1, wherein the amount of the ferromagnetic powder is selected to be about 20% and about 55%, by weight, when the permanent magnet surface flux density is selected to be about 1500 gauss and about 400 gauss, respectively.

7. The process as set forth in claim 1 wherein the amount of the ferromagnetic powder is selected to be between about 25–40%, by weight, when the permanent magnet surface flux density is selected to be between about 600–1200 gauss.

8. The process as set forth in claim 1, wherein the magnetic toner contains about 25–40%, by weight, of cobalt powder.

9. The process as set forth in claim 1, wherein the magnetic toner contains about 25–40%, by weight, of barrium ferrite powder.

10. The process as set forth in claim 1, wherein the magnetic toner contains about 25–40%, by weight, of strontium ferrite powder.

* * * * *